US012799665B2

(12) United States Patent
Rios Acebal et al.

(10) Patent No.: US 12,799,665 B2
(45) Date of Patent: Nov. 17, 2026

(54) LAUNDRY TREATING APPLIANCE WITH A VENT FLAP

(71) Applicant: WHIRLPOOL CORPORATION, Benton Harbor, MI (US)

(72) Inventors: Marcos Javier Rios Acebal, Monterrey (MX); Brian K. Rogers, Watervliet, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 139 days.

(21) Appl. No.: 18/806,839

(22) Filed: Aug. 16, 2024

(65) Prior Publication Data

US 2024/0410104 A1 Dec. 12, 2024

Related U.S. Application Data

(62) Division of application No. 17/510,533, filed on Oct. 26, 2021, now Pat. No. 12,084,806.

(51) Int. Cl.
*D06F 58/20* (2006.01)
*D06F 58/04* (2006.01)

(52) U.S. Cl.
CPC ..... *D06F 58/20* (2013.01); *D06F 58/04* (2013.01)

(58) Field of Classification Search
CPC ..... D06F 58/20
See application file for complete search history.

(56) References Cited

U.S. PATENT DOCUMENTS

| | | | |
|---|---|---|---|
| 9,644,310 | B2 | 5/2017 | Cimetta et al. |
| 10,961,654 | B2 | 3/2021 | Dunn et al. |
| 2019/0218701 | A1 | 7/2019 | Strait |
| 2021/0095409 | A1 | 4/2021 | Koo |

FOREIGN PATENT DOCUMENTS

| | | | |
|---|---|---|---|
| AU | 2006200791 | A1 | 9/2006 |
| BR | PI0601313 | A | 11/2006 |
| CA | 2538642 | A1 | 9/2006 |
| CN | 1837453 | A | 9/2006 |
| EP | 1700944 | B1 | 10/2013 |
| KR | 20140114649 | A1 * | 9/2014 |

OTHER PUBLICATIONS

English Machine Translation of KR2014011649A1 (Year: 2014).*

* cited by examiner

*Primary Examiner* — Jason Y Ko
(74) *Attorney, Agent, or Firm* — Brooks Kushman, P.C.

(57) ABSTRACT

A method for operating a laundry treating appliance having a housing; a treating chamber located within the housing. A duct fluidly coupling the treating chamber to an exterior of the housing with a vent located within the duct. The vent moveable between an open position where a fluid flow passes freely between the treating chamber and the exterior and a closed position where the treating chamber is fluidly isolated from the exterior.

17 Claims, 8 Drawing Sheets

LAUNDRY TREATING APPLIANCE WITH A VENT FLAP

CROSS-REFERENCE TO RELATED APPLICATION(S)

This application is a divisional application of U.S. patent application Ser. No. 17/510,533, filed on Oct. 26, 2021, now U.S. U.S. Pat. No. 12,084,806, issued Sep. 10, 2024, which is hereby incorporated herein by reference in its entirety.

BACKGROUND

Laundry treating appliances, such as clothes washers, clothes dryers, combination washer/dryers, refreshers, and non-aqueous systems, can have a configuration based on a rotating drum, located within a tub, which is located within a housing. The drum defines a treating chamber having an access opening and the housing has a corresponding opening. An annular bellow often extends between the housing opening and the tub and/or drum. A closure, such as a door, is typically provided to effectively close the access opening during operation of the appliance. The closure can form a liquid seal with the housing and/or the bellow.

BRIEF SUMMARY

In one aspect, the present disclosure relates to a method of operating a laundry treating appliance comprising opening a vent flap located within a duct extending between a treating chamber of the laundry treating appliance and an exterior of the laundry treating appliance to an open position; flowing a fluid through the duct between the treating chamber and the exterior; closing the vent flap to a closed position; and blocking a flow of fluid through the duct between the treating chamber and the exterior.

In another aspect, the present disclosure relates to a method of removing fluid from a treating chamber of a laundry treating appliance comprising opening a vent flap located within a duct extending between a treating chamber of the laundry treating appliance and an exterior of the laundry treating appliance to an open position and flowing the fluid through the duct between the treating chamber and the exterior.

DETAILED DESCRIPTION

Aspects of the present disclosure relate to a vent flap for a laundry treating appliance. The vent flap can be moved between an open position and a closed position. The vent flap can be opened and closed due to a pressure differentiation or mechanically utilizing a fan or blower. The vent flap can be used in any type of laundry treating appliance including but not limited to a clothes dryer or a combination washer/dryer (combo).

Figure 1:
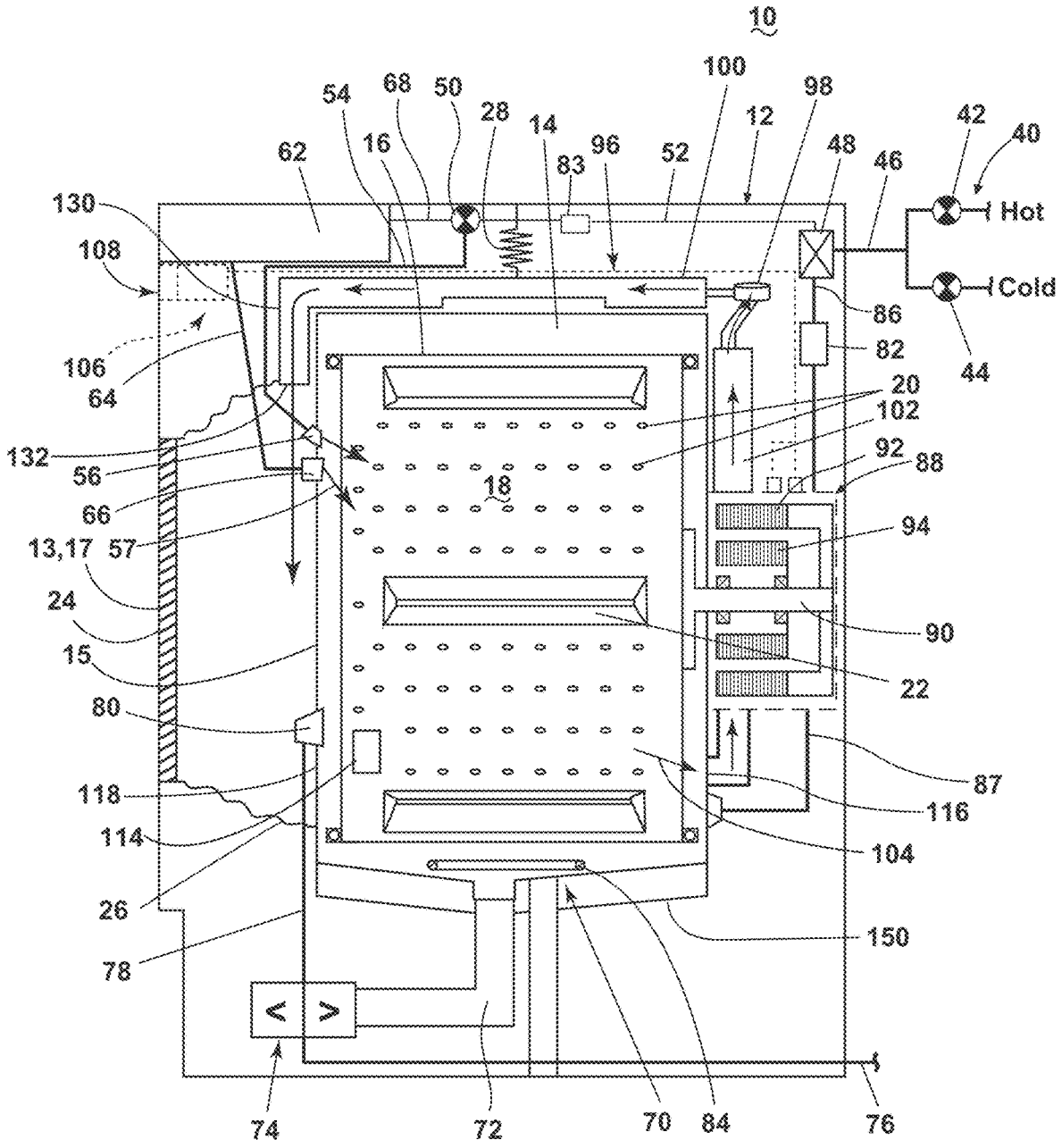
FIG. 1 illustrates a schematic cross-sectional view of a laundry treating appliance in the form of a combination washing and drying machine having an air flow assembly according to an aspect of the present disclosure.

FIG. 1 is a schematic cross-sectional view of a laundry treating appliance according to an aspect of the present disclosure. The laundry treating appliance can be any appliance which performs an automatic cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. While the laundry treating appliance is illustrated herein as a horizontal axis, front-load laundry treating appliance, the aspects of the present disclosure can have applicability in laundry treating appliances with other configurations.

Washing machines are typically categorized as either a vertical axis washing machine or a horizontal axis washing machine. The terms vertical axis and horizontal axis are often used as shorthand terms for the manner in which the appliance imparts mechanical energy to the load of laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover can typically be moved in a reciprocating rotational movement. In some vertical axis washing machines, the drum rotates about a vertical axis generally perpendicular to a surface that supports the washing machine. However, the rotational axis need not be vertical. The drum can rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a housing, while in a front-loading washing machine laundry items are placed into the drum through an access opening in the front of a housing. If a washing machine is a top-loading horizontal axis washing machine or a front-loading vertical axis washing machine, an additional access opening is located on the drum.

The exemplary laundry treating appliance of FIG. 1 is illustrated as a horizontal axis combination washing and drying machine 10, which can include a structural support system comprising a cabinet, with a cabinet opening 13, and which defines a housing 12 within which a laundry holding system resides. While illustrated as a combination washing and drying machine 10 it should be understood that the method as described herein can be implemented in a stand-alone washing machine or a stand-alone dryer. The housing 12 can be a housing having a chassis and/or a frame, to which decorative panels can or cannot be mounted, defining an interior enclosing component typically found in a conventional washing machine, such as motors, pumps, fluid lines, controls, sensors, transducers, and the like. Such components will not be described further herein except as necessary for a complete understanding of the present disclosure.

The laundry holding system comprises a tub 14, with a tub opening 15, dynamically suspended within the structural support system of the housing 12 by a suitable suspension system 28 and a drum 16, with a drum opening 17, provided within the tub 14, the drum 16 defining at least a portion of a treating chamber 18. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The drum 16 can include a plurality of perforations 20 such that liquid can flow between the tub 14 and the drum 16 through the perforations 20. It is also within the scope of the present disclosure for the laundry holding system to comprise only one receptacle with the receptacle defining the laundry treating chamber for receiving the load to be treated. At least one lifter 22 can extend from a wall of the drum 16 to lift the laundry load received in the treating chamber 18 while the drum 16 rotates.

The laundry holding system can further include a closure 24 which can be movably mounted to the housing 12 to selectively close the cabinet opening 13, which is aligned with the tub and drum openings 15 and 17. An annular bellows 26 can extend between the cabinet opening 13 and the tub opening 15 or, alternatively, the drum opening 17. The bellows includes an inner peripheral surface 27. The closure 24 sealing against the annular bellows 26 when the closure 24 closes the cabinet opening 13. The closure 24 may be any known closure device such as, but not limited to, a door, a hatch, a drawer, or the like.

The combination washing and drying machine 10 can further comprise a washing circuit which can include a liquid supply system for supplying water to the combination washing and drying machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 or the drum 16 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid 58 into the tub 14. In this manner, water from the household water supply 40 can be supplied directly to the tub 14. While the valves 42, 44 and the inlet conduit 46 are illustrated exteriorly of the housing 12, it will be understood that these components can be internal to the housing 12.

The combination washing and drying machine 10 can also be provided with a dispensing system for dispensing treating chemistry 57 to the treating chamber 18 for use in treating the load of laundry according to a cycle of operation. The dispensing system can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry 57 directly to the tub 14 or mixed with water from the liquid supply system through a dispensing outlet conduit 64. The dispensing outlet conduit 64 can include a dispensing nozzle 66 configured to dispense the treating chemistry 57 into the tub 14 in a desired pattern and under a desired amount of pressure. For example, the dispensing nozzle 66 can be configured to dispense a flow or stream of treating chemistry 57 into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the housing 12, or within a separate dispenser housing which can be provided in the housing 12. The treating chemistry dispenser 62 can be moveable between a fill position, where the treating chemistry dispenser 62 is exterior to the housing 12 and can be filled with treating chemistry 57, and a dispense position, where the treating chemistry dispenser 62 are interior of the housing 12.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The combination washing and drying machine 10 can also include a recirculation and drain system for recirculating liquid within the laundry holding system and draining liquid from the combination washing and drying machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the combination washing and drying machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In this manner, liquid provided to the tub 14, with or without treating chemistry 57 can be recirculated into the treating chamber 18 for treating the load of laundry within.

The liquid supply and/or recirculation and drain system can be provided with a heating system which can include one or more devices for heating laundry and/or liquid supplied to the tub 14, such as a steam generator 82, an inline heater 83 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition, or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the combination washing and drying machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The combination washing and drying machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The motor 88 can rotate the drum 16 at various speeds in opposite rotational directions. In particular, the motor 88 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the at least one lifter 22. Typically, the force applied to the fabric items at the tumbling speeds is less than about 1G. Alternatively, the motor 88 can rotate the drum 16 at spin speeds wherein the fabric items rotate with the drum 16 without falling. The spin speeds can also be referred to as satellizing speeds or sticking speeds. Typically, the force applied to the fabric items at the spin speeds is greater than or about equal to 1G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The combination washing and drying machine 10 can further include a recirculation system 96 that can be a closed loop or an open loop circuit. A closed loop system is illustrated where the recirculation system 96 can include a blower 98, a condenser 100, and a heating element 102. The condenser 100 can be provided with a condenser drain conduit (not shown) that fluidly couples the condenser 100 with the pump 74 and the drain conduit 76. Condensed liquid collected within the condenser 100 can flow through the condenser drain conduit to the pump 74, where it can be provided to the recirculation and drain system. In an exemplary aspect, the recirculation system 96 can be provided adjacent an upper portion of the tub 14, though it will be understood that the recirculation system 96 need not be provided adjacent an upper portion of the tub 14, and can be provided at any suitable location adjacent the tub 14. It is further contemplated that an open loop circuit is implemented where air is heated, passes through the drum 16 and is exhausted out of the combination washing and drying machine 10, in which case a condenser 100 is not necessary.

The recirculation system 96 may supply the drying air 104 to the treating chamber 18 via the perforations 20, or through a recirculation conduit 130 including an inlet 116, and an outlet 132. At least a portion of the drying air 104 can enter the treating chamber 18 via the recirculation conduit 130 and the chassis opening 118.

The combination washing and drying machine 10 also includes a control system for controlling the operation of the combination washing and drying machine 10 to implement one or more cycles of operation. The control system can include a controller 106 located within the housing 12 and a user interface 108 that is operably coupled with the controller 106. The user interface 108 can include one or more knobs, dials, switches, displays, touch screens and the like for communicating with the user, such as to receive input and provide output. The user can enter different types of information including, without limitation, cycle selection and cycle parameters, such as cycle options.

The controller 106 can include the machine controller and any additional controllers provided for controlling any of the components of the washing machine 10. For example, the controller 106 can include the machine controller and a motor controller. Many known types of controllers can be used for the controller 106. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
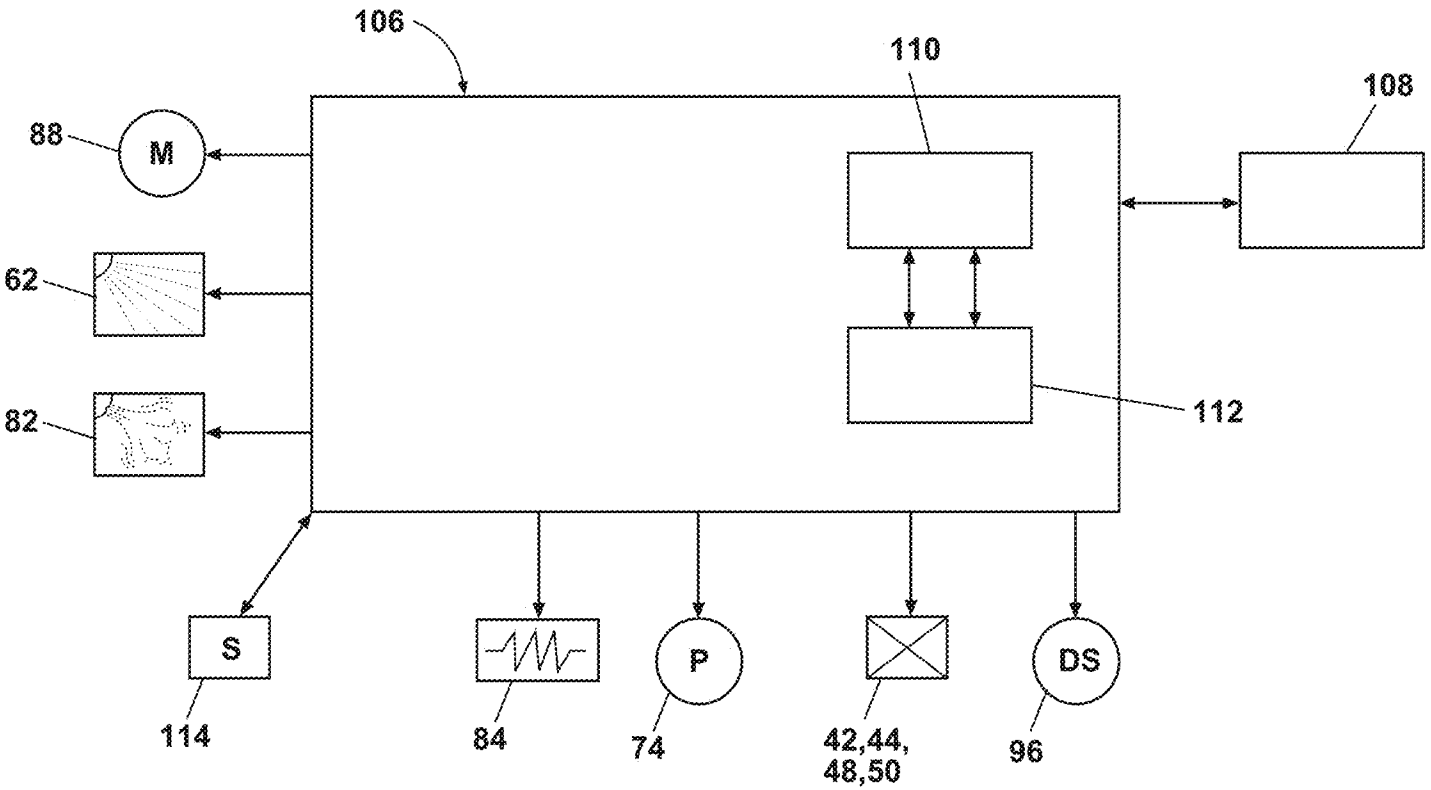
FIG. 2 illustrates a schematic of a control system of the laundry treating appliance of FIG. 1 according to an aspect of the present disclosure.

As illustrated in FIG. 2, the controller 106 can be provided with a memory 110 and a central processing unit (CPU) 112. The memory 110 can be used for storing the control software that is executed by the CPU 112 in completing a cycle of operation using the combination washing and drying machine 10 and any additional software. Examples, without limitation, of cycles of operation include: wash, heavy duty wash, delicate wash, quick wash, pre-wash, refresh, rinse only, and timed wash. The memory 110 can also be used to store information, such as a database or table, and to store data received from one or more components of the combination washing and drying machine 10 that can be communicably coupled with the controller 106. The database or table can be used to store the various operating parameters for the one or more cycles of operation, including factory default values for the operating parameters and any adjustments to them by the control system or by user input.

The controller 106 can be operably coupled with one or more components of the combination washing and drying machine 10 for communicating with and controlling the operation of the component to complete a cycle of operation. For example, the controller 106 can be operably coupled with the motor 88, the pump 74, the treating chemistry dispenser 62, the steam generator 82, the sump heater 84, and the recirculation system 96 to control the operation of these and other components to implement one or more of the cycles of operation.

The controller 106 can also be coupled with one or more sensors 114 provided in one or more of the systems of the washing machine 10 to receive input from the sensors, which are known in the art and illustrated in FIG. 1 in a lower portion of the treating chamber 18 for exemplary purposes only. Non-limiting examples of sensors 114 that can be communicably coupled with the controller 106 include: a treating chamber temperature sensor, a moisture sensor, a weight sensor, a chemical sensor, a position sensor and a motor torque sensor, which can be used to determine a variety of system and laundry characteristics, such as laundry load inertia or mass.

Figure 3:
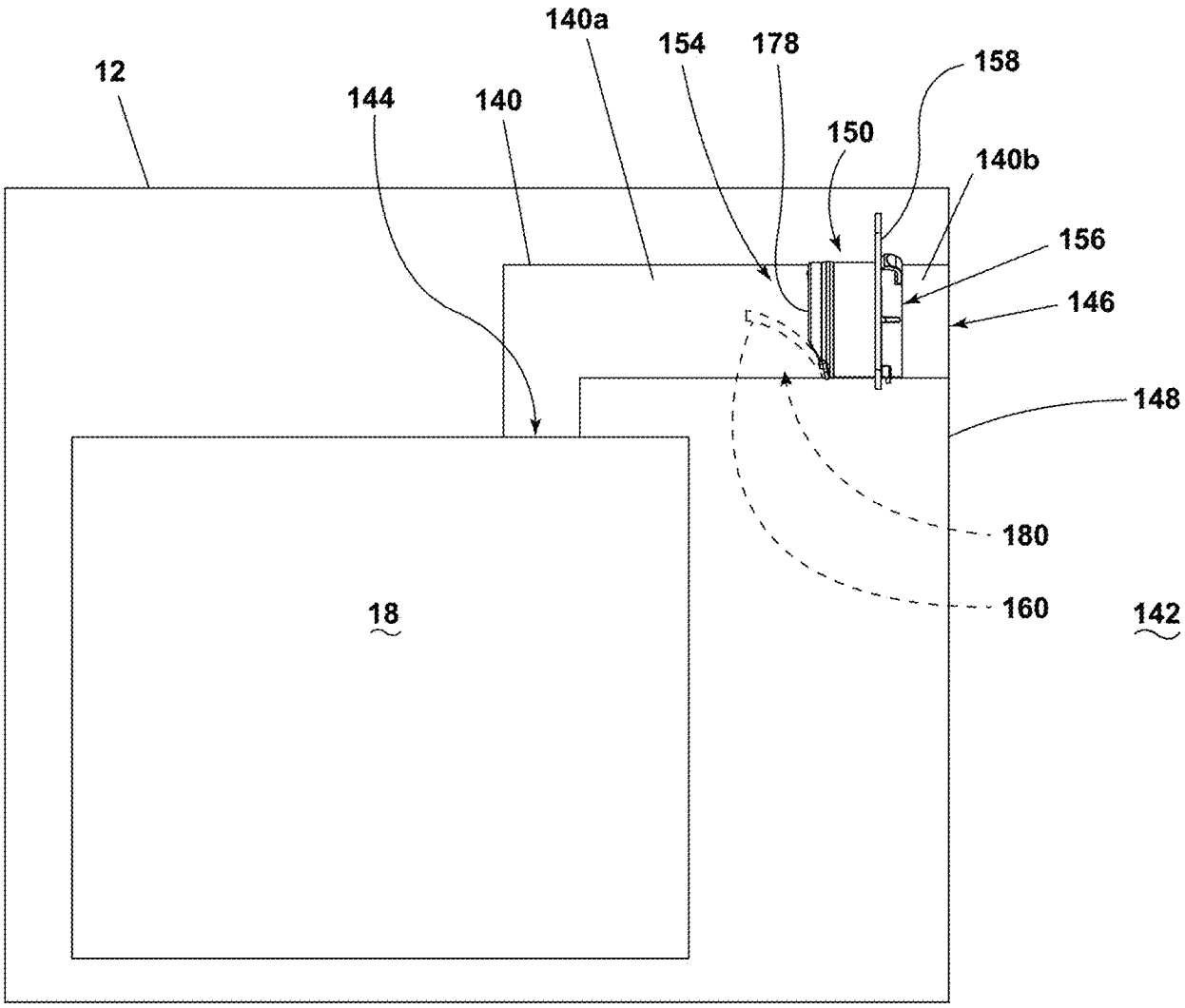
FIG. 3 is a schematic of a laundry treating appliance with a treating chamber and a duct fluidly coupling the treating chamber to an exterior of the laundry treating appliance with a housing structure located within the duct.

FIG. 3 is a schematic of a laundry treating appliance, by way of non-limiting example, the exemplary laundry treating appliance of FIG. 1 with the housing 12 and the treating chamber 18 located within the housing 12. A duct 140 can fluidly couple the treating chamber 18 to an exterior 142 of the housing 12. The duct can extend from a duct inlet 144 at the treating chamber 18 to a duct outlet 146 at the exterior 142. The outlet 146 can be located on a rear 148 of the housing 12.

A housing structure 150 can be mounted within the duct 140. It is further contemplated that the housing structure 150 is a duct coupling 152 having a coupling inlet 154 fluidly coupled to the duct inlet 144 and a coupling outlet 156 fluidly coupled to the duct outlet 146. It should be understood that the duct 140 can be any number of duct parts, by way of non-limiting example a first duct portion 140*a* extending between the duct inlet 144 and the coupling inlet 154 and a second duct portion 140*b* extending between the coupling outlet 156 and the duct outlet 146. The housing structure 150 can be mounted in place by a flange 158. A vent flap 160 can be attached to the housing structure 150 for movement between a closed position 178 and an open position 180 illustrated in dashed line.

Figure 4:
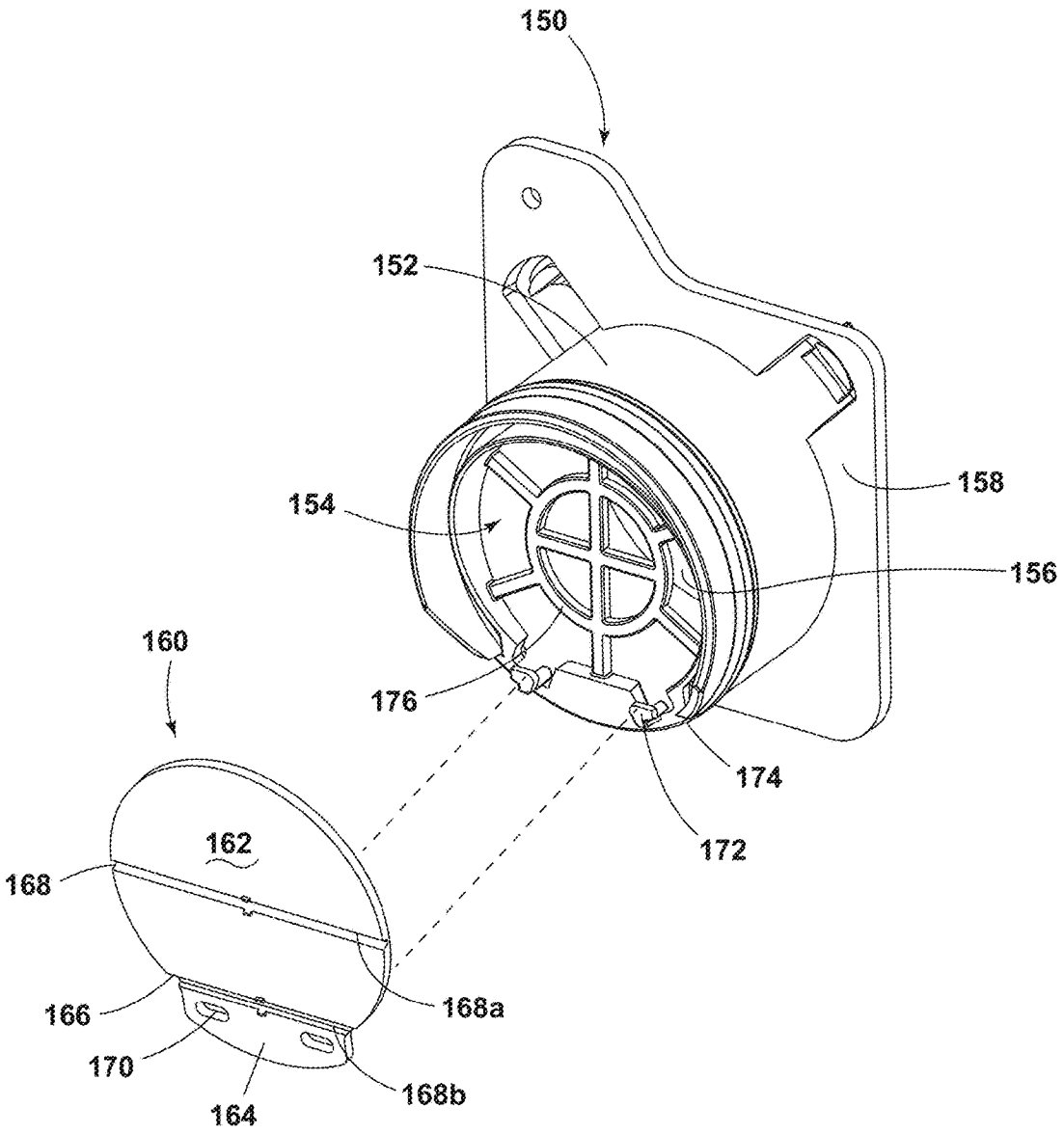
FIG. 4 is an enlarged perspective view of the housing structure with a vent flap exploded therefrom.

Turning to FIG. 4, an enlarged perspective view of the housing structure 150 with the vent flap 160 exploded therefrom is illustrated. The vent flap 160 can have a substantially circular body 162, though any suitable shape for placement within the duct 140 is contemplated. The vent flap 160 can include a hinge portion 164 extending from a bottom 166 of the body 162. At least one indent 168 can be formed within the vent flap 160. A first indent 168*a* can extend through a center of the body 162 along a full diameter of the body 162 dividing the body 162 into a top portion 162*a* and a bottom portion 162*b*. A second indent 168*b* can be located at the bottom 166 between the bottom portion 162*b* and the hinge portion 164. A set of openings 170, illustrated as a pair of openings can be formed in the hinge portion 164.

A set of tabs 172 can be located on a bottom 174 of the housing structure 150. When assembled the vent flap 160 can be pivotally mounted to the housing structure 150 when the set of tabs 172 is received in the set of openings 170. An openwork 176 can be located at the coupling inlet 154. The openwork 176 can be a framework upon which the vent flap 160 can align when in the closed position 178. The openwork 176 can allow a fluid flow movement freely between the coupling inlet 154 and the coupling outlet 156 while preventing any movement of larger objects, such as the vent flap 160, toward the coupling outlet 156.

Figure 5:
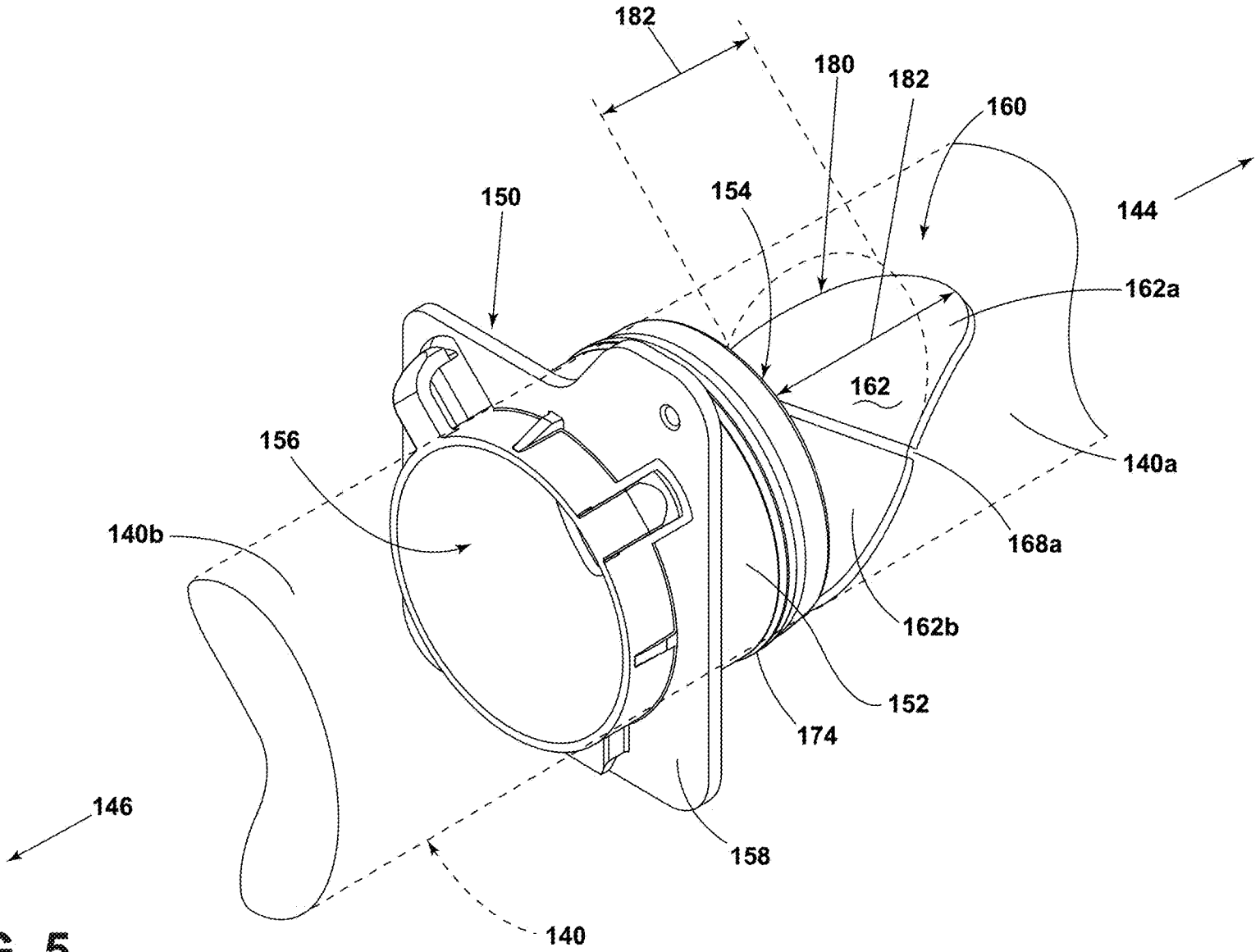
FIG. 5 is a perspective view of the housing structure on an opposite side of vent flap.

FIG. 5 is a perspective view of housing structure 150 on the side of the coupling outlet 156. The vent flap 160 is illustrated in the open position 180. The top portion 162*a* of the body 162 can flex at the first indent 168*a*. The vent flap 160 can be made of a flexible material such as rubber to ensure a maximum opening 182 when in the opened position 180. The maximum opening 182 is larger than a minimum opening 184 resulting from a more rigid vent flap 160 illustrated in dashed line. Both a rigid and flexible vent flap 160 are contemplated depending on implementation and use. The vent flap 160 is located at the coupling inlet 154 on the side of the duct coupling 152 fluidly coupled to the duct inlet 144 such that the vent flap 160 opens toward the duct inlet 144 when in the open position 180.

Figure 6:
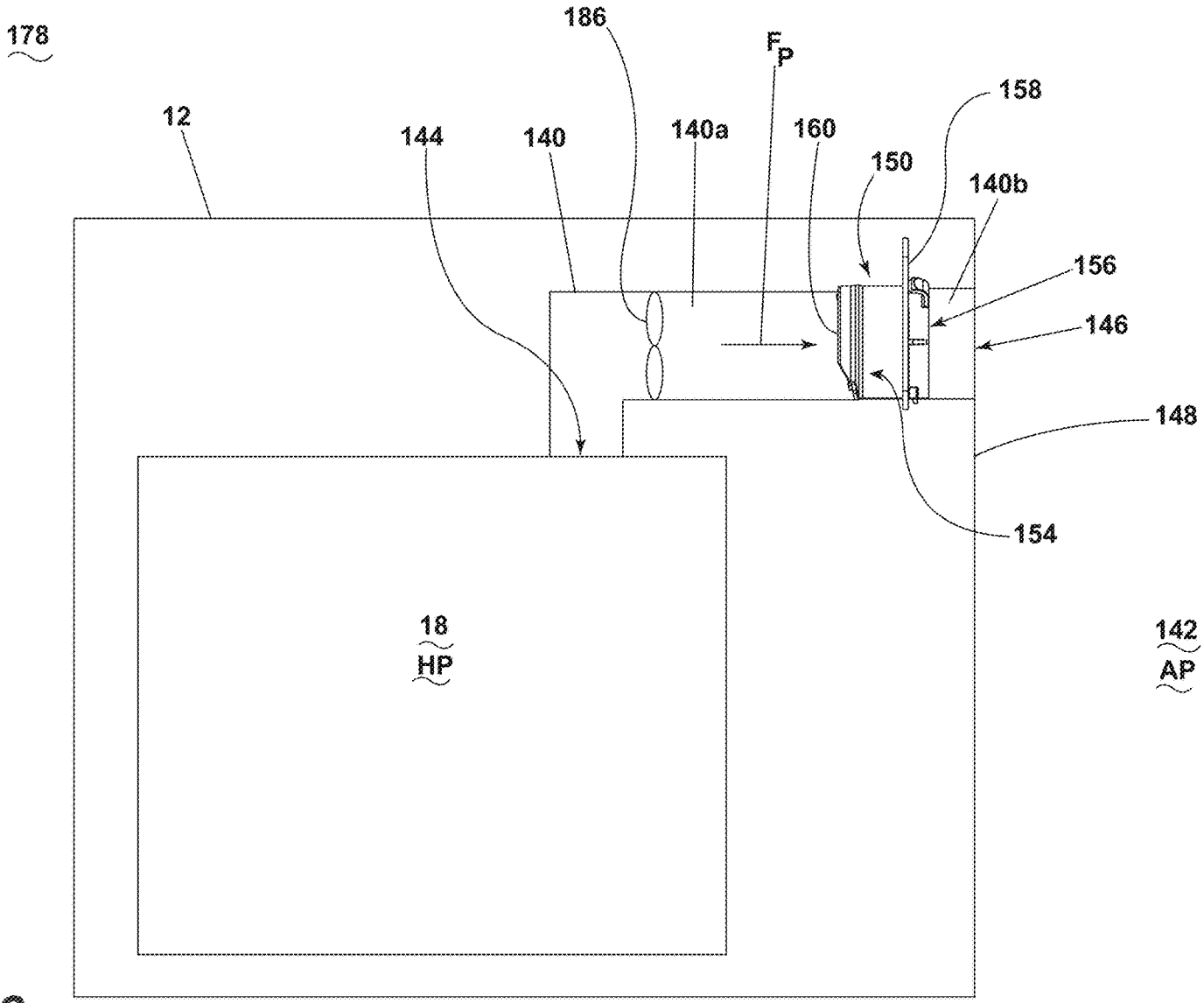
FIG. 6 is the schematic of the laundry treating appliance of FIG. 3 illustrating a closed position of the vent flap.

FIG. 6 is the schematic of the laundry treating appliance of FIG. 3 illustrating the closed position 178 where the treating chamber 18 is fluidly isolated from the exterior 142. During operation the treating chamber 18 can undergo an increase in pressure to define a high pressure zone (HP). High pressure defines as higher than an ambient pressure (AP) of the exterior 142. The increase in pressure within the treating chamber 18 causes the vent flap 160 to move from the open position 180 to the closed position 178. This pressure differentiation causes a pushing force (P) on the vent flap 160 moving the vent flap 160 into the closed position 178. The increase in pressure within the treating chamber 18 can be caused by a drying cycle. Other cycle modes can also cause an increase in pressure, by way of non-limiting example including a heating cycle or a starting cycle.

It is further contemplated that a fan 186 can be located within the duct 140. In the event the vent flap 160 needs to be moved to the closed position 178, the fan 186 can be turned on to produce the pushing force (Fp) for holding the vent flap 160 in the closed position 178. The controller 106 can include a manual and/or automatic switch for operating the fan 186.

Figure 7:
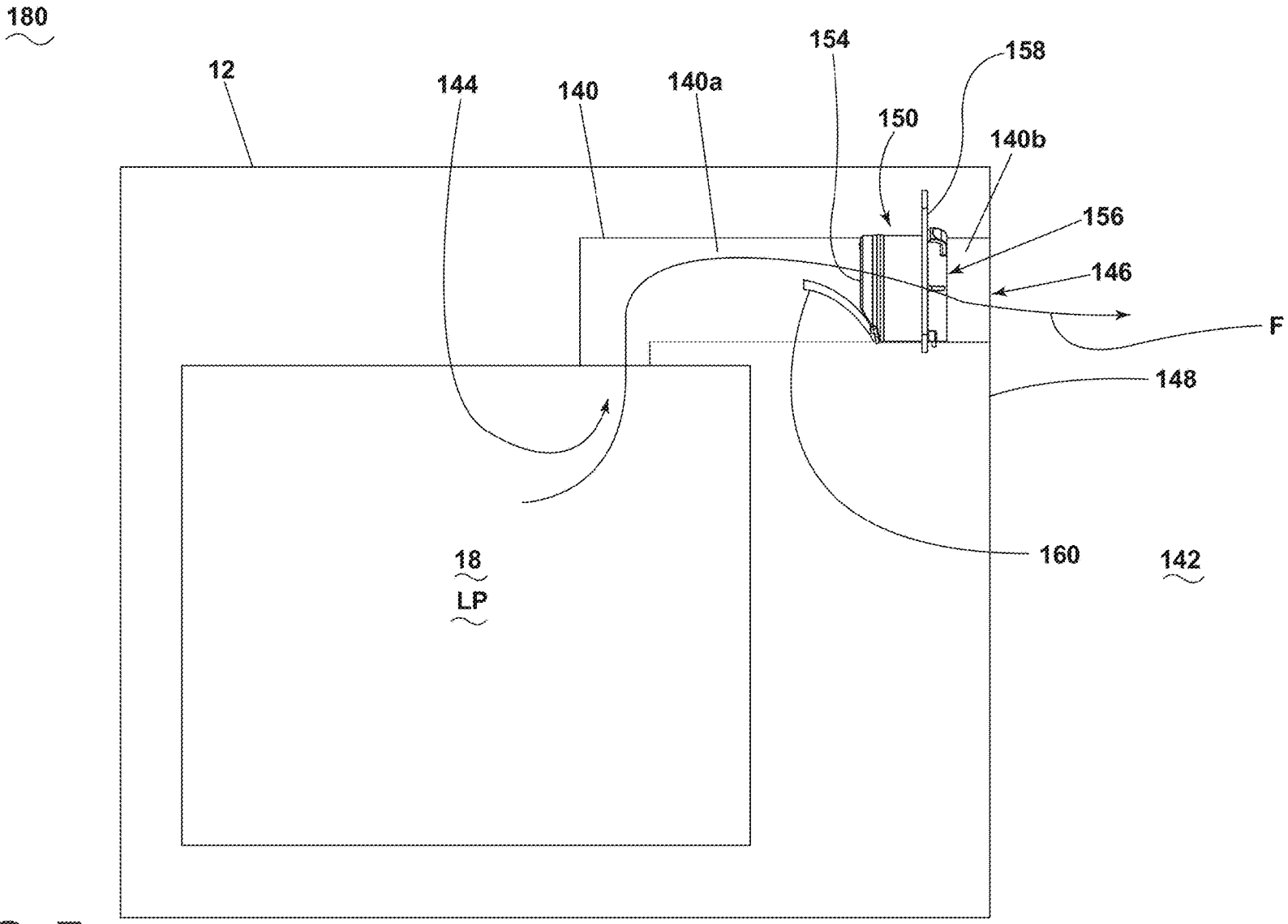
FIG. 7 is the schematic of the laundry treating appliance of FIG. 3 illustrating an open position of the vent flap.

FIG. 7 is the schematic of the laundry treating appliance of FIG. 3 illustrating the open position 180 where a fluid flow (F) passes freely between the treating chamber (18) and the exterior 142. During operation the treating chamber 18 can undergo a decrease in pressure to define a low pressure zone (LP). Low pressure meaning lower than or equal to an ambient pressure (AP) of the exterior 142. The decrease in pressure within the treating chamber 18 causes the vent flap 160 to move from the closed position 178 to the open position 180. This change in pressure removes the pushing force (FIG. 6) on the vent flap 160 leaving only gravity which causes the vent flap 160 to drop into the open position 180. The decrease in pressure within the treating chamber 18 can be caused by a tumbling cycle. Other cycle modes can also cause a decrease in pressure, by way of non-limiting example including an end of cycle or ceasing of operation.

Figure 8:
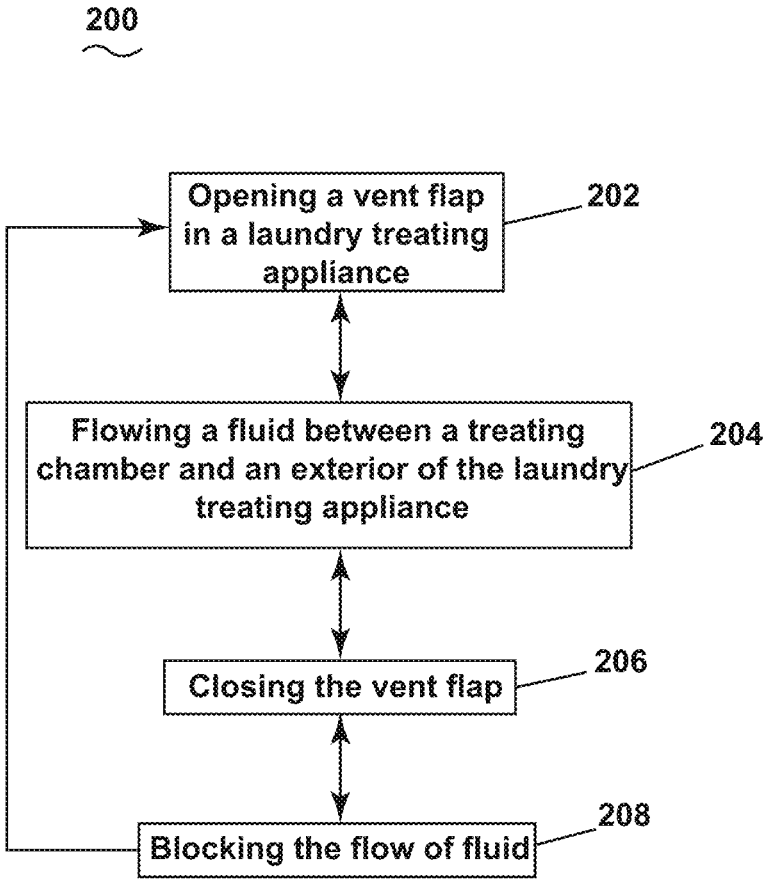
FIG. 8 is a flow chart of a method of operation for the laundry treating appliance of FIG. 3.

FIG. 8 is a flow chart of a method 200 for operating the laundry treating appliance of FIG. 3. The method includes at 202 opening the vent flap 160 to the open position 180. Opening the vent flap 160 can include decreasing a pressure within the treating chamber 18 to move the vent flap 160 from the closed position 178 to the open position 180. As described herein, decreasing the pressure within the treating chamber 18 can occur by initiating a tumbling cycle or by initiating an end of cycle of operation in the laundry treating appliance. At 204, a fluid flow (F) can flow through the duct 140 between the treating chamber 18 and the exterior 142. The fluid flow (F) can include carbon monoxide CO or other gasses built up within the treating chamber 18.

At 206, closing the vent flap 160 to the closed position 178 can occur in order to at 208 block the fluid flow (F) from flowing through the duct 140 between the treating chamber 18 and the exterior 142. Closing the vent flap 160 can include increasing a pressure within the treating chamber 18 to move the vent flap 160 from the open position 180 to the closed position 178. As described herein increasing the pressure within the treating chamber 18 can occur by initiating a drying cycle of operation in the laundry treating appliance. Blocking the fluid flow (F) from flowing can ensure efficient operating conditions of the laundry treating appliance.

Benefits associated with the placement of the duct and vent flap discussed herein include ensuring a closed treating chamber for more efficient drying cycles. An escape route for any trapped CO is provided when the laundry treating appliance is not in operation ensuring breathable air. Additionally, the vent flap prevents foul odor due by enabling natural air flow when the machine is off.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure.

The invention claimed is:

1. A method of operating a laundry treating appliance comprising:

opening a vent flap located within a duct extending between a treating chamber of the laundry treating appliance and an exterior of the laundry treating appliance to an open position;

flowing a fluid through the duct between the treating chamber and the exterior;

closing the vent flap to a closed position; and blocking a flow of fluid through the duct between the treating chamber and the exterior;

wherein the fluid is carbon monoxide.

2. The method of claim 1, further comprising increasing a pressure within the treating chamber to move the vent flap from the open position to the closed position.

3. The method of claim 2, further comprising initiating a drying cycle to increase the pressure within the treating chamber.

4. The method of claim 1, further comprising decreasing a pressure within the treating chamber to move the vent flap from the closed position to the open position.

5. The method of claim 4, further comprising initiating a tumbling cycle to decrease the pressure within the treating chamber.

6. The method of claim 4, further comprising initiating an end of cycle to decrease the pressure within the treating chamber.

7. The method of claim 1, wherein the vent flap is pivotally mounted within the duct.

8. The method of claim 7, wherein the vent flap is pivotally mounted to a bottom of the duct for movement between open and closed positions.

9. The method of claim 1, further comprising operating a fan to hold the vent flap in a closed position.

10. The method of claim 1, further comprising opening the vent flap toward a duct inlet at the treating chamber.

11. A method of removing fluid from a treating chamber of a laundry treating appliance comprising:

opening a vent flap located within a duct extending between a treating chamber of the laundry treating appliance and an exterior of the laundry treating appliance to an open position; and flowing the fluid through the duct between the treating chamber and the exterior;

wherein the fluid is carbon monoxide.

12. The method of claim 11, further comprising decreasing a pressure within the treating chamber to open the vent flap by moving the vent flap from a closed position to an open position.

13. The method of claim 12, further comprising initiating a tumbling cycle to decrease the pressure within the treating chamber.

14. The method of claim 12, further comprising initiating an end of cycle to decrease the pressure within the treating chamber.

15. The method of claim 11, further comprising closing the vent flap to a closed position and blocking a flow of fluid through the duct between the treating chamber and the exterior.

16. The method of claim 11, further comprising increasing a pressure within the treating chamber to close the vent flap by moving the vent flap from an open position to a closed position.

17. The method of claim 16, further comprising initiating a drying cycle to increase the pressure within the treating chamber.

* * * * *